United States Patent [19]

Ohuchi

[11] Patent Number: 5,056,483

[45] Date of Patent: Oct. 15, 1991

[54] ENGINE SPEED CONTROL APPARATUS

[75] Inventor: Hirofumi Ohuchi, Himeji, Japan

[73] Assignee: Mitsubishi Denki Kabushiki Kaisha, Tokyo, Japan

[21] Appl. No.: 554,483

[22] Filed: Jul. 19, 1990

[30] Foreign Application Priority Data

Jul. 27, 1989 [JP] Japan ..... 1-196163
Jul. 27, 1989 [JP] Japan ..... 1-196164

[51] Int. Cl.[5] ..... F02M 3/00
[52] U.S. Cl. ..... 123/339; 123/585
[58] Field of Search ..... 123/339, 585, 478, 488, 123/491, 480, 494, 179 L, 479, 340; 73/115, 116, 117.3

[56] References Cited

U.S. PATENT DOCUMENTS

| | | | |
|---|---|---|---|
| 4,883,034 | 11/1989 | Yashiki et al. | 123/339 |
| 4,884,540 | 12/1989 | Kishimoto et al. | 123/339 |
| 4,887,570 | 12/1989 | Meicher | 123/339 |
| 4,903,657 | 2/1990 | Miyazaki et al. | 123/339 |
| 4,933,371 | 6/1990 | Albertson et al. | 123/339 |

*Primary Examiner*—Raymond A. Nelli

*Attorney, Agent, or Firm*—Sughrue, Mion, Zinn, Macpeak and Seas

[57] ABSTRACT

An engine speed control apparatus capable of controlling the idling speed of an engine without entailing abnormal rise or fall of engine speed while the engine is in operation in an idling mode. An engine speed control apparatus comprises a switch means which assumes a predetermined state when the degree of opening of a throttle valve is in a range from a fully closed state to a predetermined value of opening, an idling mode detecting means which detects an idling mode of the engine on the basis of the operating conditions of the engine which include the output signal of the switch means, and a control means which controls the air intake rate of the engine in a feed-back control mode while the engine is operating in an idling mode so that the engine speed coincides with a target speed, wherein the idling mode detecting means detects the idling mode of the engine by detecting the throttle valve which is in a predetermined range of throttle opening narrower than said predetermined range from the fully closed state to the predetermined value.

2 Claims, 8 Drawing Sheets

ENGINE SPEED CONTROL APPARATUS

The present invention relates to an engine speed control apparatus. More particularly, it relates to an engine speed control apparatus which detects a degree of opening of a throttle valve to thereby control the idling speed of an engine.

A conventional engine speed control apparatus performs a closed-loop control operation in the judgment of an idling mode when the vehicle is stopped and an idle switch is closed, namely, the throttle valve is closed, and performs an open-loop control operation in the judgement of a non-idling mode when the vehicle is running or the idle switch is open, whereby the engine speed is controlled by controlling an amount of air to be supplied to the engine.

The open-loop control operation is intended to maintain constant the opening of an air control valve provided in a bypass passage bypassing the throttle valve of the engine.

The closed-loop control operation is such that a target engine speed and a basic air feed rate are calculated on the basis of the operating conditions of the engine determined through the detection of the operating conditions of the electrical load, the active range of the automatic transmission, the temperature of the engine cooling water and the like; a feed-back correction quantity is obtained from an error between the actual engine speed from a target speed, and the degree of opening of the air control valve is controlled by using the sum of the basic air feed rate and the feed-back correction.

Since fuel feed rate is dependent on air feed rate, the actual engine speed can be controlled through the control of air feed rate. The foregoing conventional engine speed control apparatus employs an inexpensive idle switch which is installed in a throttle opening sensor. The idle switch is closed to indicate that the engine is operating in the idling mode when $\theta_{IDL}<\theta<\theta_{IDL}+\beta$, $\theta_{IDL}$ is a reference value of the degree of idling throttle opening when the throttle valve is entirely closed, $\theta$ is an actual value of the degree of throttle opening, and $\beta$ is a positive value, as shown in FIG. 4 showing the variation of actual engine speed Ne with actual value of the degree of throttle opening $\theta$, so that the closed-loop control operation is executed. Accordingly, in some cases, the idle switch is closed when the actual value of the degree of throttle opening $\theta$ is in the range expressed by the inequality, even if the accelerator pedal is depressed slightly to open the throttle valve slightly. If the closed-loop control operation is performed in such a state, the actual engine speed exceeds the target engine speed greatly over the target engine speed and the air control valve is substantially fully closed. If the accelerator pedal is released to close the throttle valve fully while the engine is operating in such a mode, the actual engine speed decreases at a rate higher than the response speed of the closed-loop control operation for opening the air control valve to a certain opening, because the air control valve is substantially fully closed and the air control valve is still closed. Consequently, the actual engine speed drops far below the target engine speed causing the body to vibrate and, the in the worst case, causes the engine to stop.

In case the idle switch of the conventional engine speed control apparatus malfunctions to provide an off-signal indicating an operating mode other than the idling mode instead of an on-signal indicating the idling mode while the throttle valve is closed and the engine is operating in the idling mode, the open-loop control operation for a non-idling mode is performed. Consequently, the engine speed varies according to the variation of load on the engine, such as electrical load, and, in the worst case, the engine is brought to a stop.

It is possible that the same problems arises when a throttle valve opening sensor for detecting a degree of opening of the throttle valve is employed in order to detect the idling mode.

If the idle switch has an excessively wide range of throttle opening, the closed-loop control operation is unable to control the engine properly. Since the rate of decrease of the engine speed due to insufficient intake air feed is higher than the rate of opening the air control valve according to the closed-loop control operation even if the throttle opening falls within the control range of the closed-loop control operation when the air control valve is closed and the throttle valve is fully closed, the engine speed drops excessively and, in the worst case, the engine is brought to a stop.

Accordingly, it is an object of the present invention to provide an engine speed control apparatus capable of properly controlling the operating speed of an engine without entailing abnormal rise or fall of engine speed.

In one aspect of the present invention, there is provided an engine speed control apparatus which comprises a switch means which assumes a predetermined state when the degree of opening of a throttle valve is in a range from a fully closed state to a predetermined value of opening, an idling mode detecting means which detects an idling mode of the engine on the basis of the operating conditions of the engine which include the output signal of the switch means, and a control means which controls the air intake rate of the engine in a feed-back control mode while the engine is operating in an idling mode so that the engine speed coincides with a target speed, wherein the idling mode detecting means detects the idling mode of the engine by detecting the throttle valve which is in a predetermined range of throttle opening narrower than said predetermined range from the fully closed state to the predetermine value. In a second aspect of the present invention, there is provided an engine speed control apparatus comprising a control means which controls the idling speed of the engine in a feed-back control mode while the engine is in operation in an idling mode by regulating the air intake rate of the engine on the basis of parameters representing the operating conditions of the engine, a switch means which detects a throttle valve being closed, a throttle valve opening degree detecting means which detects the degree of opening of the throttle valve, and a detecting means which detects that at least either the switch means or the throttle valve opening degree detecting means is normal and the engine is in the idling mode, wherein the control means performs a feed-back control operation to control the idling speed of the engine upon the reception of the detection signal provided by the detecting means.

Figure 1:
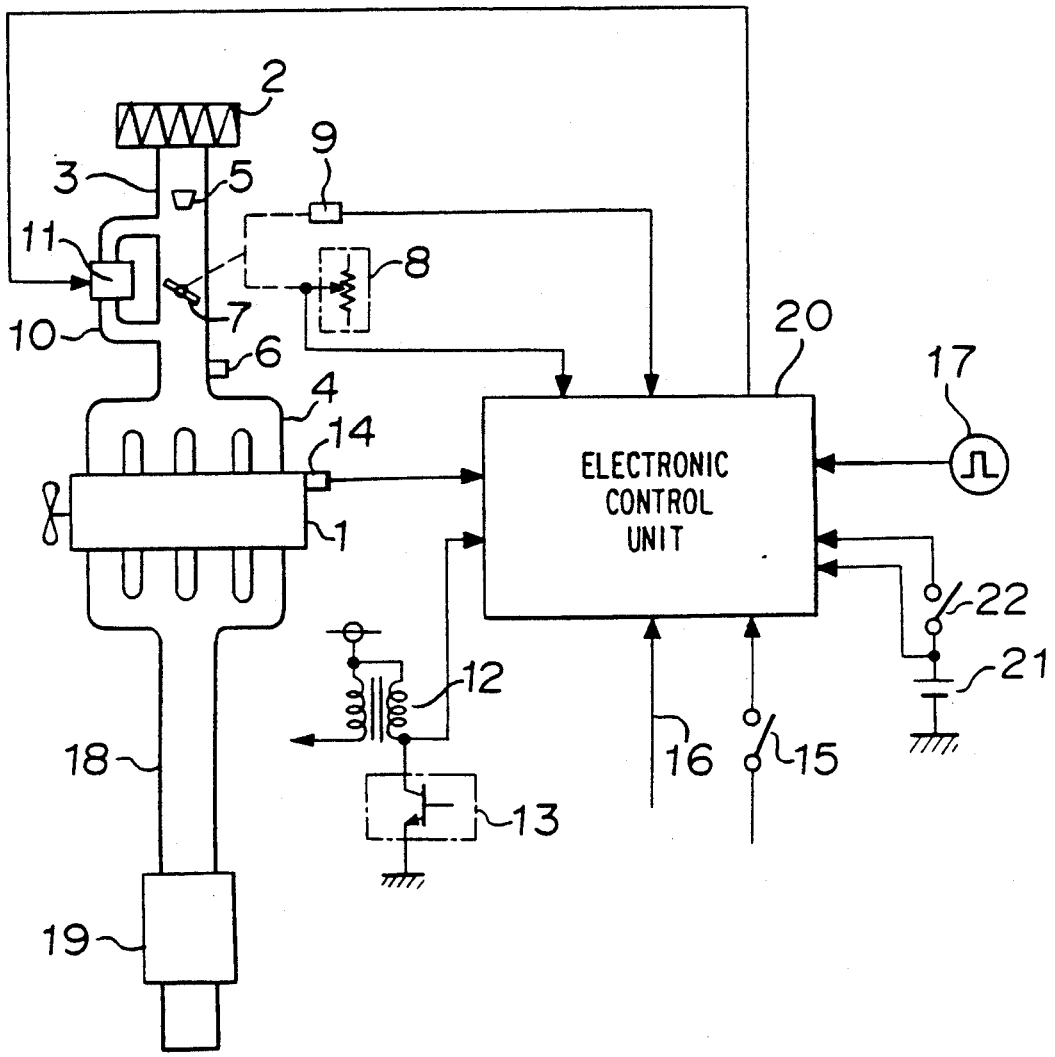
FIG. 1 is a block diagram of an engine speed control apparatus in a first embodiment according to the present invention.

Referring to FIG. 1 showing an engine speed control apparatus in a first embodiment according to the present invention, an engine 1 mounted, for example, on an automobile, intakes air mainly through an air cleaner 2, an intake pipe 3 and an intake manifold 4. Fuel is injected to the intake pipe 3 by an electromagnetic fuel injection valve 5 provided in the intake pipe 3. The quantity of fuel injected in one fuel injection cycle is determined by a fuel control system, not shown, on the basis of the output signal of a pressure sensor 6 for detecting the internal absolute pressure of the intake pipe 3. Also shown in FIG. 1 are a throttle valve 7 operated by the accelerator pedal, not shown, to regulate the main air intake rate of the engine 1, a throttle opening sensor 8 for detecting the degree of opening of the throttle valve 7, an idle switch 9 for detecting the substantially fully closed state of the throttle valve 7, a bypass passage 10 connected to the intake pipe 3 at the downstream side of the electromagnetic fuel injection valve 5 so as to bypass the throttle valve 7, an air control valve 11 provided in the bypass passage 11.

The idle switch 9 becomes ON when $\theta_{IDL}$ is a value of opening degree of the throttle valve when the throttle valve 7 is fully closed and $\beta$ is a positive value. The bypass passage 10 has one end connected to an air intake opening formed in the intake pipe 3 between the electromagnetic fuel injection valve 5 and the throttle valve 7, and the other end connected to an air outlet opening formed in the intake pipe 3 at the downstream side of the throttle valve 7 The air control valve 11 is, for example, an electromagnetic control valve, the degree of opening of which varies according to the duty ratio of a driving signal given thereto to regulate the cross-sectional area of the bypass passage 10 in proportion to the duty ratio.

The ignition device of the engine 1 is controlled by an ignition control system which produces an ignition signal with reference to parameters representing the operating conditions of the engine 1. The ignition system comprises an ignition coil 12, an igniter 13 which controls the primary current that flows through the primary coil of the ignition coil 12 in an on-off mode, a distributor, not shown and a spark plug, not shown.

The temperature of the engine 1 is represented by the temperature of the engine cooling water detected by a temperature sensor 14. Further shown in FIG. 1 are an electrical load switch 15 for actuating an auxiliary equipment, such as an air conditioner, a signal line 16 for transmitting a signal representing the torque converter of the automatic transmission, a running speed sensor 17 which produces a pulse signal of a frequency proportional to the rotating speed of the axle representing the running speed of the vehicle, the exhaust pipe 18 of the engine 1, a catalytic exhaust gas purifier 19 for purifying the exhaust gas, an electronic control unit 20, a key switch 22, and a battery 21 for supplying power through the key switch 22 to the electronic control unit 20.

The electronic control unit 20 determines the operating condition of the engine 1 from the output signals of the idle switch 9, the throttle opening sensor 8 and the running speed sensor 17, determines the controlled variable of the air control valve 11 for the closed-loop control of the air control valve 11 according to the operating condition of the engine 1 on the basis of an ignition signal produced by the primary coil of the ignition coil 12, a temperature signal produced by the temperature sensor 14, a signal provided by the electrical load switch 15 and signals transmitted thereto through the signal line 16, and determines the controlled variable of the air control valve 11 for the open-loop control of the air control valve 11.

The electronic control unit 20 will be described hereinafter with reference to FIG. 2. The electronic control unit 20 comprises a microcomputer 100, a first input interface 101, a second input interface 102, a third input interface 103, an output interface 104, a first power circuit 105 and a second power circuit 106.

Figure 3:
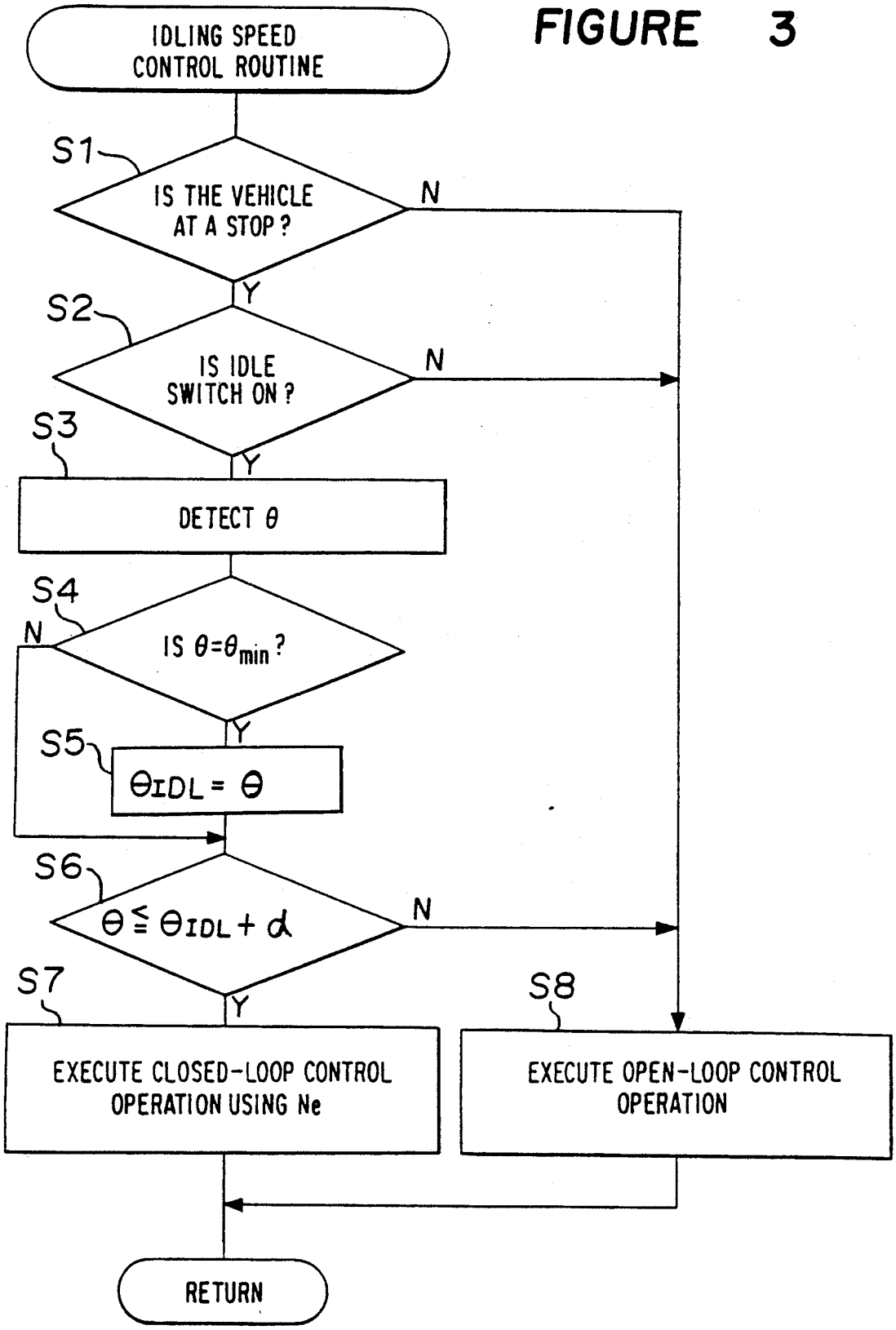
FIG. 3 is a flow chart of the control program to be executed by the engine speed control apparatus of FIG. 1.

The microcomputer 100 comprises a CPU 200 for calculating controlled variables for the control of the idling of the engine 1 according to a given program, a free-running counter 201 for measuring the operating speed of the engine 1, a timer 202 for timing the duration of application of a driving signal to the air control valve 11 according to a duty ratio, an A/D converter 203 for converting analog input signals into corresponding digital output signals, an input port 204 for receiving digital input signals, a RAM (random-access memory) 205 serving as a scratchpad memory, a ROM (read-only memory) 206 storing programs as shown in FIG. 3, an output port 207 for sending out driving signals, and a common bus 208.

The first input interface 101 gives a primary ignition signal produced by the ignition coil 12 to the microcomputer 100 as an interruption signal after shaping the waveform of the primary ignition signal. When the interruption signal is produced, the CPU 200 reads a count obtained by the counter 201, calculated the current engine speed from the difference between the current count and the preceding count and stores the current engine speed in the RAM 205. The second input interface 102 gives the output signals of the throttle opening sensor 8 and the temperature sensor 14 after noise reduction to the A/D converter 203. The third input interface 103 adjusts the levels of on-state signals indicating the on-state of the idle switch 9 and the on-state of the electrical load switch 15, a neutral safety signal transmitted through the signal line 16 and the pulse signal provided by the running speed sensor 17 to predetermined level and applies the signals of the predetermined level to the input port 204. The output interface 104 applies a driving signal provided through the output port 207 after amplification to the air control valve 11. The first power circuit 105 regulates the output voltage of the battery 21 at a fixed voltage and applies the fixed voltage to the microcomputer 100 while the key switch 22 is in an on-state. The second power circuit 106 supplies power from the battery 21 to the RAM 205 regardless of the state of the key switch 22 to keep the RAM 205 unvolatile.

The operation of the engine speed control apparatus will be described hereinafter with reference to FIG. 1 to 3, particularly, with reference to FIG. 3.

In step S1, determination is made as to whether or not the vehicle is at a stop, namely, if any pulse signal is produced by the running speed sensor 17. When the response in step S1 is affirmative, determination is made in step S2 as to whether or not the idle switch 9 is ON, namely, whether or not the throttle valve 7 is substantially fully closed. When the response in step S2 is affirmative, the CPU 200 reads the output of the throttle opening sensor 8 representing an actual value of the degree of throttle opening $\theta$ through the second interface 102 and the A/D converter 203 in step S3. In step S4, determination is made as to whether or not the actual value of the degree of throttle opening $\theta$ coincides with the minimum value $\theta_{min}$. When the response in step S4 is negative, the control jumps to step S6. When the response in step S4 is affirmative, the actual value of the degree of throttle opening $\theta$ is stored in the RAM 205 as a reference value of the degree of idling throttle opening $\theta$IDL to update the minimum value $\theta_{min}$, and then the control goes to step S6.

In step S6, determination is made as to whether or not $\theta \leqq \theta_{IDL}+\alpha$, where $\alpha$ is a correction value of the degree of throttle opening for identifying the idling mode and $0<\alpha<\beta$. When the response in step S6 is affirmative, that is, the value of the degree of throttle opening $\theta$ is not greater than the limit of closed-loop control and the air control valve 11 is not substantially fully closed, a closed-loop control operation is performed in step S7 to control the opening of the air control valve 11 with reference to an actual engine speed Ne. The closed-loop control operation uses the signal produced by the temperature sensor 14, the signal indicating the state of the electrical load switch 15, the signal transmitted through the signal line 16 and the actual engine speed Ne determined on the basis of the frequency of the ignition signals provided by the ignition coil 12.

When the response in step S1 is negative, namely, when a pulse signal is generated by the running speed sensor 17 and the vehicle is running, when the response in step S2 is negative, namely, when the idle switch 9 is OFF, or when the response in step S6 is negative, namely, when $\theta<\theta_{IDL}+\alpha$, the determinating that the air control valve is substantially fully closed is given, step S8 is executed. In step S8, the air control valve 11 is adjusted to a predetermined opening through an open-loop control operation.

The control returns to step S1 to repeat the steps of the program for the subsequent control cycle after step S7 or S8 has been executed.

Figure 4:
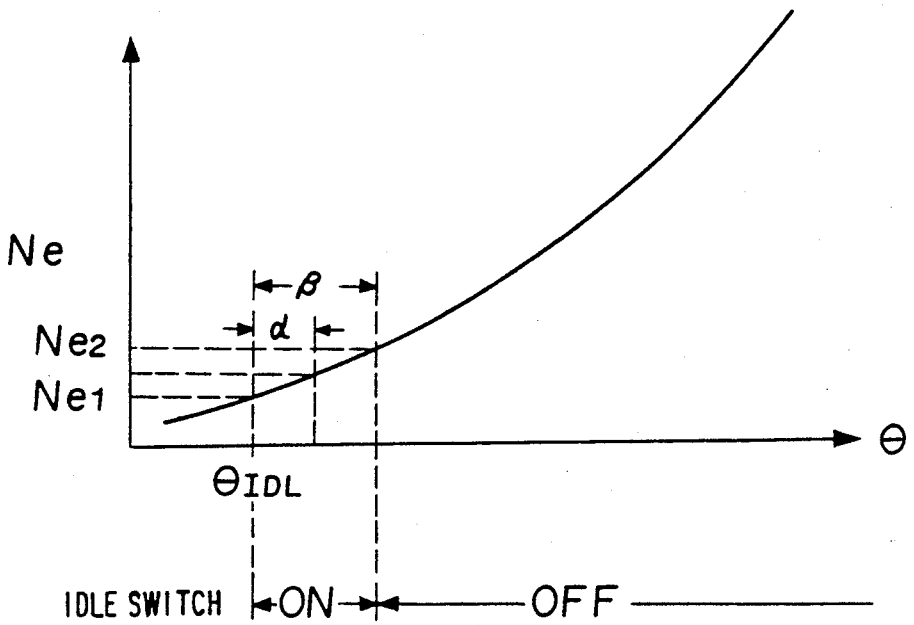
FIG. 4 is a graph showing the variation of engine speed with a value of opening of the throttle valve.

FIG. 4 shows the variation of actual engine speed Ne (the vertical axis) with actual value of the degree of throttle opening $\theta$ (the horizontal axis), and the state of the idle switch 9 corresponding to actual value of the degree of throttle opening $\theta$. When the actual valve of the degree of throttle opening $\theta$ is equal to the reference value of the degree of idling throttle opening $\theta_{IDL}$, the actual engine speed Ne coincides with Ne1, which, for example, is 800 rpm. When $\theta=\theta_{IDL}+\beta$, the actual engine speed Ne coincides with Ne2, which, for example, is 1200 rpm. When $\theta_{IDL} \leqq \theta \leqq \theta_{IDL}+\alpha$ and the vehicle is at a stop, it is determined that the engine is operating in an idling mode and the closed-loop control operation is performed. In this range of throttle opening, the closed-loop control is effective. In this embodiment, the second power circuit 106 is not necessarily essential and the RAM 205 may be a volatile memory.

Figure 5:
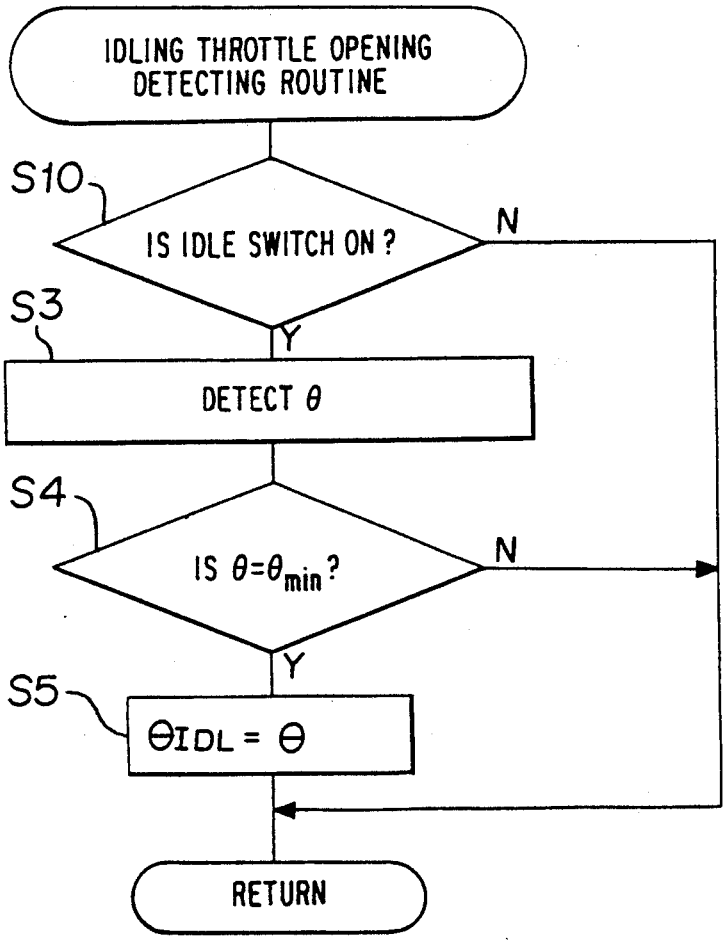
FIG. 5 is a flow chart of a control program for throttle opening detection in an idling mode to be executed by an engine speed control apparatus in a second embodiment according to the present invention.

FIG. 5 shows control program for throttle opening detection in an idling mode to be executed by an engine speed control apparatus in a second embodiment according to the present invention, in which steps corresponding to those previously described with reference to FIG. 3 are denoted by the same step numbers. The control program shown in FIG. 5 executes steps S3, S4 and S5 of FIG. 3 independently of the idling speed control operation. The idling speed control operation is achieved by executing step S6 and the following steps after the affirmative decision in Step S2 in FIG. 3. The idling speed control operation is performed after completing the control program of FIG. 5, the description of which will be omitted.

Referring to FIG. 5, determination is made in step S10 as to whether or not the idle switch 9 is ON. When the response in step S10 is affirmative, namely, when the idle switch 9 is ON, steps S3 and S4, or steps S3, S4 and S5 are executed. When the response in step S10 is negative, namely, when the idle switch 9 is OFF, the control returns to the calling program. When the response in step S4 is negative or after step S5 has been executed, the control returns to the calling program. Steps S3, S4 and S5 are the same as those of FIG. 3 and hence the description thereof will be omitted. After the control has returned to the calling program, the idling speed control operation is performed, and then the control return to step S10 to repeat the foregoing idling mode detecting subroutine. The actual value of the degree of throttle opening $\theta$ detected in step S3 of FIG. 5 is used for the decision in Step S6 (FIG. 3). In FIG. 3 , the control may jump from step S3 to step S6 without omitting step S3. When so programmed, the control of FIG. 5 is the same as that performed by the engine speed control apparatus in the first embodiment.

Figure 2:
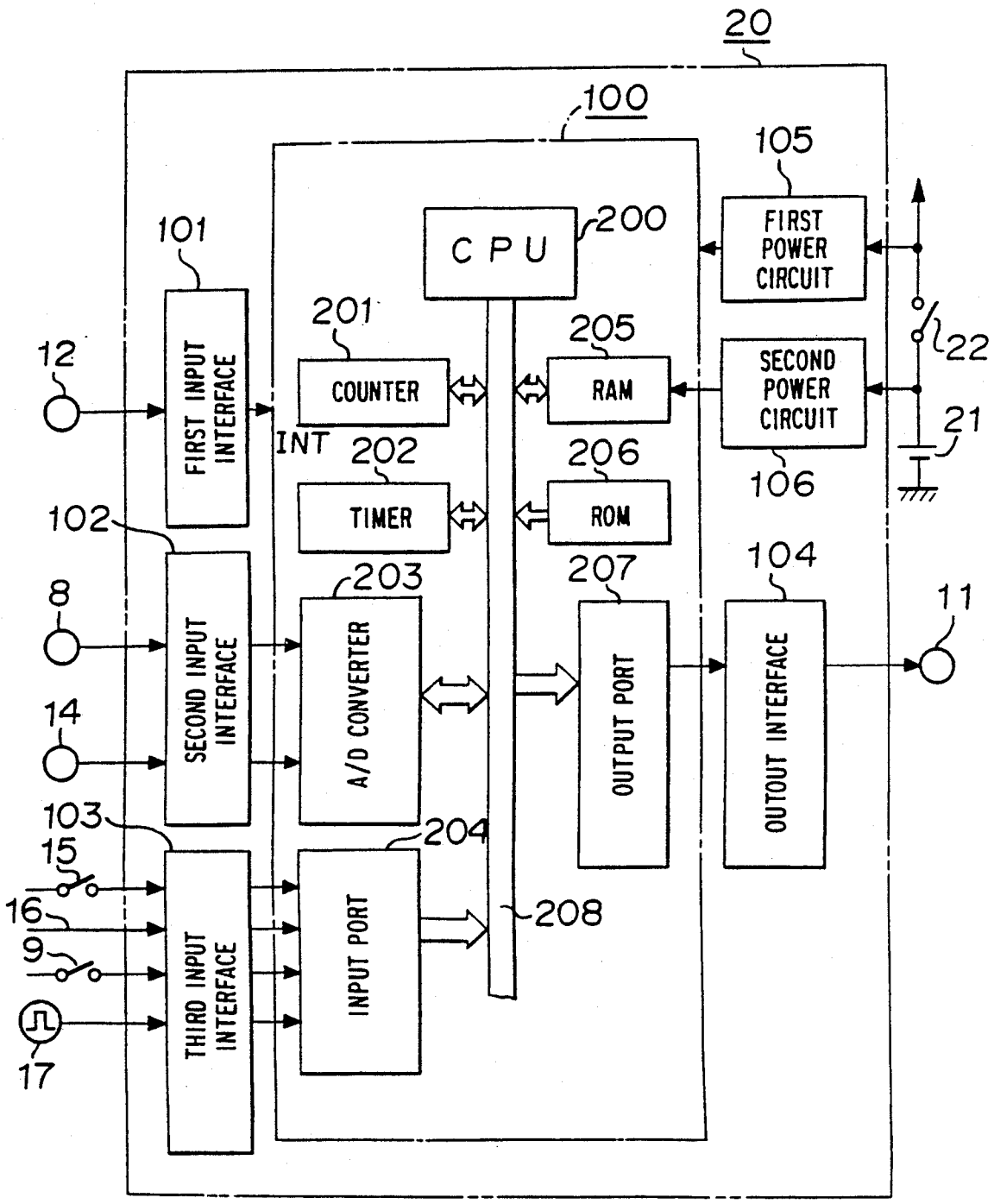
FIG. 2 is a block diagram of an electronic control unit incorporated into the engine speed control apparatus of FIG. 1.
Figure 6:
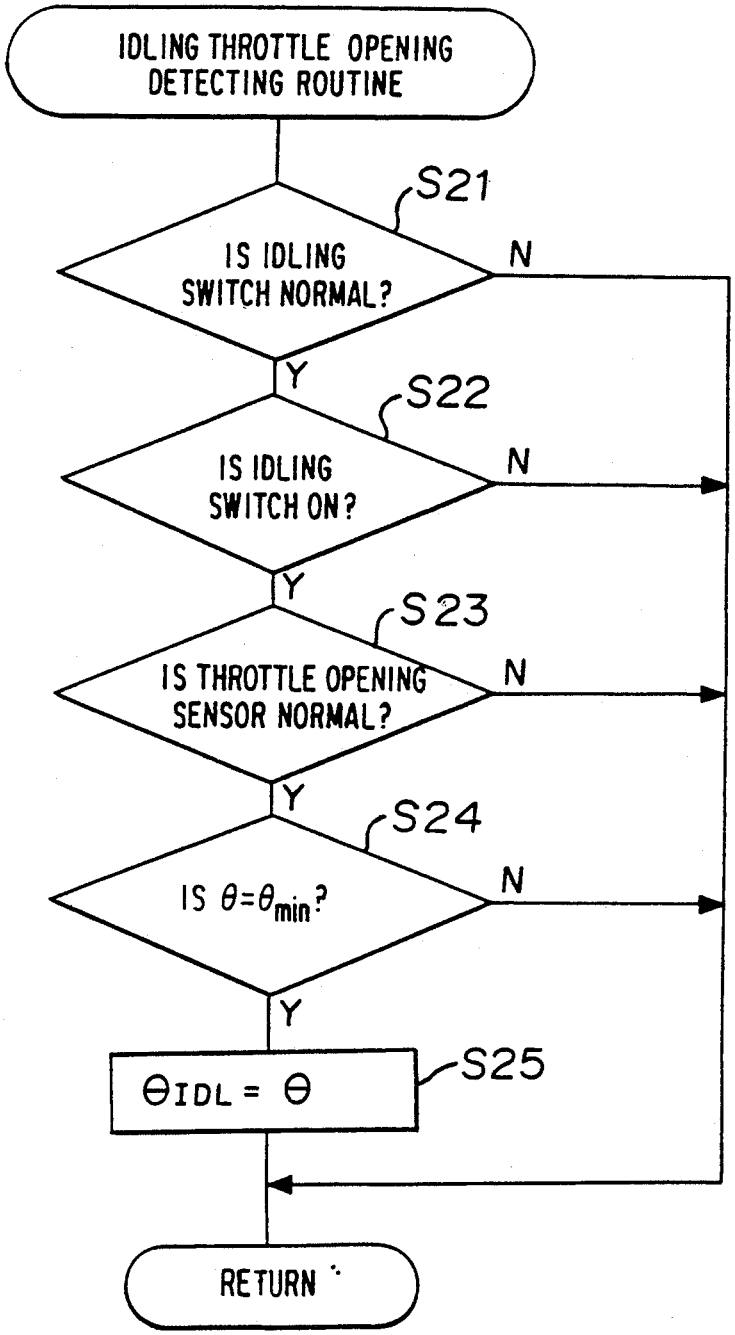
FIGS. 6 to 9 are flow charts of subroutines of another control program to be executed in accordance with the present invention.

An engine speed control apparatus in a third embodiment according to the present invention is virtually the same in construction as the engine speed control apparatus shown in FIGS. 1 and 2, hence, parts of the engine speed control apparatus in the third embodiment corresponding to those of the engine speed control apparatus in the first embodiment are denoted by the same reference characters. FIGS. 6 to 9 show control programs to be executed by the engine speed control apparatus in the third embodiment, in which, FIG. 9, in particular, shows an essential program. First, an idling throttle opening detecting program shown in FIG. 6 is executed.

Idling Throttle Opening Detecting Procedure (FIG. 6)

Figure 7:
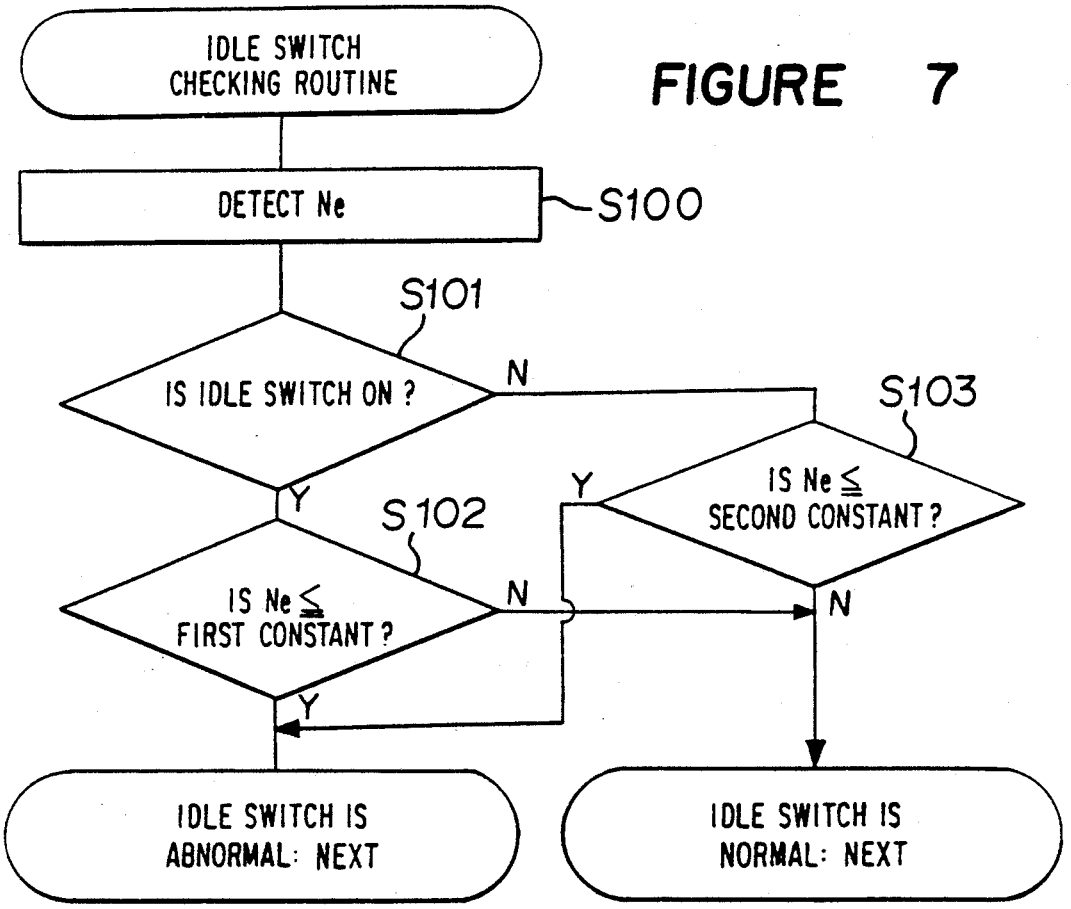
Figure 8:
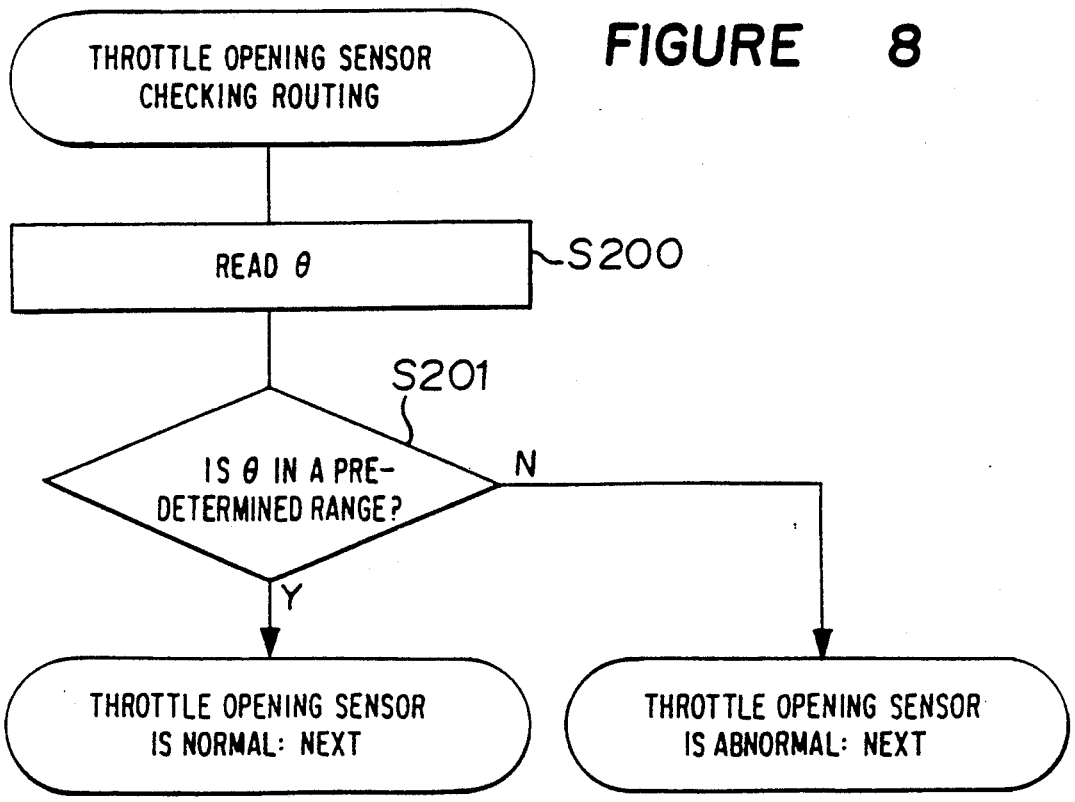

Referring to FIG. 6, and idle switch checking program shown in FIG. 7 is executed in step S21 to see if the idle switch 9 is normal. When the idle switch 9 is normal, determination is made in step S22 as to whether or not the idle switch 9 is ON. When the response in step S22 is affirmative, a throttle opening detector checking program shown in FIG. 8 is executed in Step S23 to see whether or not the throttle opening detector 8 is normal. When the throttle opening sensor 8 is normal, determination is made in step S24 as to whether or not an actual value of the degree of throttle opening $\theta$ detected by the throttle opening sensor 8 and read through the second input interface 102 and the A/D converter 203 coincides with the minimum value of the degree of throttle opening $\theta_{min}$. The actual value of the degree of throttle opening $\theta$ and the reference value of the degree of throttle opening $\theta_{IDL}$ are compared. When the response in step S24 is affirmative, the actual value of the degree of throttle opening $\theta$ is stored as the reference value of the degree of idling throttle opening $\theta_{IDL}$ to update the reference value of the degree of idling throttle opening $\theta_{IDL}$ in step S25, and then the control returns to the calling program.

Figure 9:
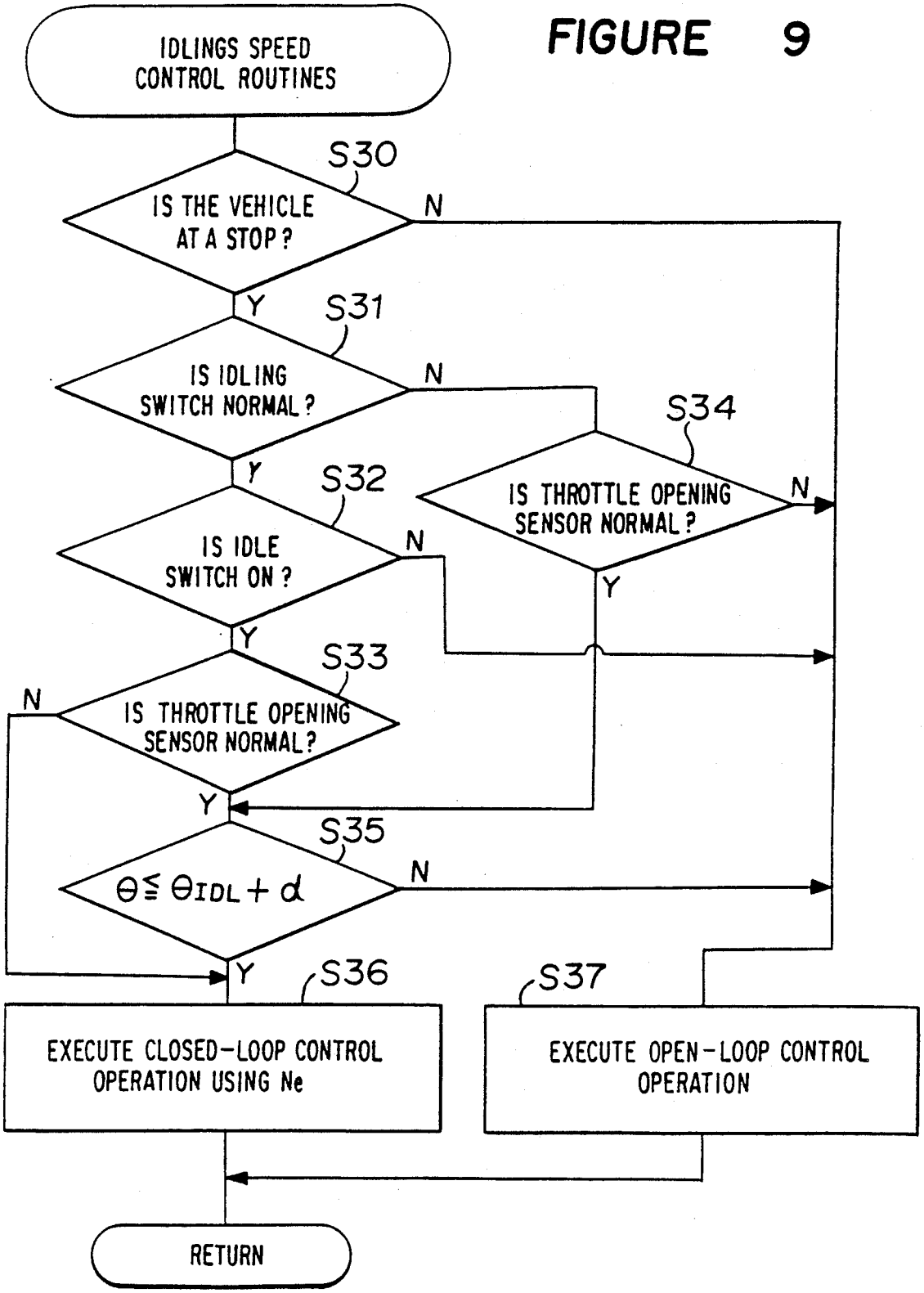

When the response in step S21 is negative, namely, when the idle switch 9 is abnormal, when the response in step S22 is negative, namely, when the idle switch 9 is OFF, when the response in step S23 is negative, namely, when the throttle opening sensor 8 is abnormal, or when the response in step S24 is negative, namely, when the actual value of the degree of throttle opening $\theta$ is not equal to the minimum value of the degree of throttle opening $\theta_{min}$, the control returns to the calling program, the control program of FIG. 9 is executed, and then step S21 is executed again to repeat the idling throttle opening detecting program of FIG. 6.

Idling Mode Detecting Switch Checking Procedure (FIG. 7)

Referring to FIG. 7, the actual engine speed Ne is calculated in step S101 on the basis of the period of rotation of the engine 1 calculated by an interruption routine, now shown. In step 101, determination is made as to whether or not the idle switch 9 is ON. When the response in step S101 is affirmative, determination is made in step S102 as to whether or not the actual engine speed Ne is equal to or higher than a predetermined first value, for example, 1500 rpm. When the idle switch 9 is abnormal, the response in step S102 is affirmative, and, when normal, the response in step S102 is negative. When the response in step S101 is negative, determination is made in step S103 as to whether or not the actual engine speed Ne is equal to or lower than a second predetermined value, for example, 1000 rpm When the idle switch 9 is abnormal, the response in step S103 is affirmative, and the idle switch 9 is normal when the response is negative.

Throttle Opening Detector Checking Procedure (FIG. 8)

Referring to FIG. 8, an actual value of the degree of throttle opening $\theta$ detected by the throttle opening sensor 8 is read in step S200 through the second input interface 102 and the A/D converter 203. In step S201, determination is made as to whether or not the actual value of the degree throttle opening $\theta$ is within a predetermined range of opening for the throttle valve 7 in the normal state. When the throttle opening sensor 8 is normal, the response in step S201 is affirmative, and when abnormal, the response is negative.

Idling Speed Control Procedure (FIG. 9)

Referring to FIG. 9, in step S30, determination is made as to whether or not vehicle is at a step, in which no pulse signal is produced by the running speed sensor 17. The control goes to step S37 when the vehicle is not at a step. When the vehicle is at a stop, determination is made in step S31 as to whether or not the idle switch 9 is normal. Although the decision in step S31 may be made through the control program shown in FIG. 7, the decision may be made through the identification of a flag, not shown in FIG. 7, representing the decision in step S21 of the control program shown in FIG. 6. When the idle switch 9 is normal, determination is made in step S37 as to whether or not the idle switch 9 is ON. When the idle switch 9 is OFF, determination is made in step S33 as to whether or not opening sensor 8 is normal. The decision in step S33 may be made through the control program shown in FIG. 8 or may be made identifying a flag, not shown in FIG. 8, representing the decision in step S23 of the control program shown in FIG. 6. Step S35 is executed when the throttle opening sensor 8 is normal, and step S36 is executed when abnormal.

When the response in step S31 is negative, namely, when the idle switch 9 is abnormal, step S34 similar to step S33 is executed to see if the throttle opening sensor 8 is normal. Step S37 is executed when the throttle opening sensor 8 is normal, and step S35 is executed when abnormal.

In step S35, determination is made as to whether or not $\theta \leqq \theta_{IDL} + \alpha$, where $\theta$ is the actual value of the degree of throttle opening, $\theta_{IDL}$ is the degree of throttle opening obtained through the procedure of FIG. 6 and $\alpha$ is value of throttle opening correction for idling mode identification and is in a range expressed by $0 < \alpha < \beta$, is satisfied. When the determination in step S35 is affirmative, the closed-loop control operation is performed in step S36 to control the opening of the air control valve 11. The closed-loop control operation uses signals provided by the temperature sensor 14 and the electrical load switch 15, a signal transmitted through the signal line 16, and the actual engine speed Ne. When the determination in step S35 is negative, the open-loop control operation is executed in step S37 to adjust the degree of opening of the air control valve 11 to predetermined value, because the air control valve 11 is fully closed.

After step S36 or S37 has been executed, the control returns to the calling program, executes the procedure shown in FIG. 6, and then returns to step S30 to repeat the idling speed control procedure.

When the actual value of the degree of throttle opening $\theta$ is equal to the reference value of the degree of idling throttle opening $\theta_{IDL}$, the actual engine speed Ne coincides with the predetermined engine speed Ne1, for example, 800 rpm. When the actual value of the degree of throttle opening $\theta$ coincides with the upper limit value of throttle opening $\theta_{IDL} + \beta$, below which the idle switch 9 is ON, the actual engine speed Ne coincides with the predetermined engine speed Ne2, for example 1200 rpm. It is decided that the engine is operating in the idling mode when the idle switch 9 is normal and ON, or when the idle switch 9 is abnormal, the throttle opening sensor 8 is normal and $\theta \leqq \theta_{IDL} + \alpha$, and the closed-loop control operation is performed. Thus, the closed loop control operation is performed when limited conditions are satisfied.

Figure 10:
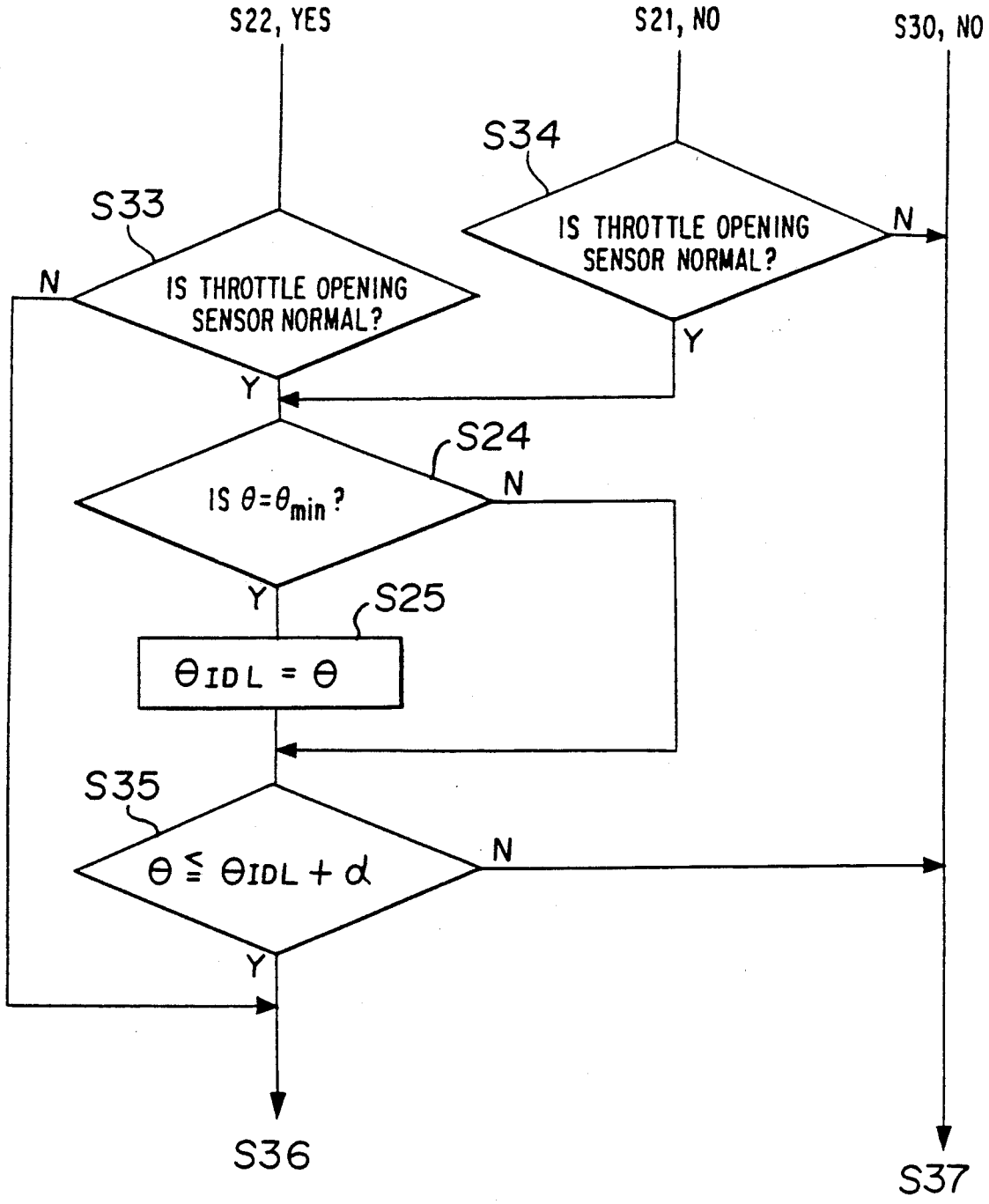
FIG. 10 is part of a control program to be executed by the engine speed control apparatus in the second embodiment according to the present invention.

FIG. 10 shows an essential portion of a control program to be carried out by an engine speed control apparatus in a fourth embodiment according to the present invention. The control program shown in FIG. 10 is a combination of portions of the control programs shown in FIGS. 6 and 9, in which steps corresponding to those in FIG. 6 and 9 are denoted by the same step numbers. The control program shown in FIG. 10 is the same as that shown in FIG. 9, except that steps S24 and S25 of FIG. 6 are interposed between the affirmative decisions in steps S33 and S34 and step S35 in FIG. 9.

When the throttle opening sensor 8 is normal (step S33 or S34), determination is made in step S24 as to whether or not the actual value of the degree of throttle opening $\theta$ is equal to the minimum value of the degree of throttle opening $\theta_{min}$. When the response in step S24 is affirmative, the actual value of the degree of throttle opening $\theta$ is stored as the reference value of the degree of idling throttle opening $\theta_{IDL}$ in step S25, and then control goes to step S35. When the response in step S24 in negative, the control jumps to step S35. The rest of the steps are the same as those shown in FIG. 9 and hence the description thereof will be omitted.

The reference value of the degree of idling throttle opening $\theta_{IDL}$ determined on the basis of the actual throttle opening may be stored continuously on the basis of the actual throttle opening may be stored continuously in the RAM 205 by supplying power to the RAM 205 regardless of the state of the key switch 22 to keep the RAM 205 unvolatile.

Thus, the feed-back control is performed when the engine is operating in an idling made and at least either the idle switch, which provides a signal when the throttle valve is fully closed, or the throttle opening sensor, which detects the opening of throttle valve, is normal. Therefore, the abnormal rise and fall of the engine speed in response to the variation of load can be prevented.

I claim:

1. An engine speed control apparatus which comprises:

a switch means which assumes a predetermined state when the degree of opening of a throttle valve is in a range from a fully closed state to a predetermined value of opening, an idling mode detecting means which detects an idling mode of the engine on the basis of the operating conditions of the engine which include the output signal of the switch means, and a control means which controls the air intake rate of the engine in a feed-back control mode while the engine is operating in an idling mode so that the engine speed coincides with a target speed, wherein the idling mode detecting means detects the idling mode of the engine by detecting the throttle valve which is in a predetermined range of throttle opening narrower than said predetermined range from the fully closed state to the predetermined value.

2. An engine speed control apparatus comprising:

a control means which controls the idling speed of the engine in a feed-back control mode while the engine is in operation in an idling mode by regulating the air intake rate of the engine on the basis of parameters representing the operating conditions of the engine, a switch means which detects a throttle valve being closed, a throttle valve opening degree detecting means which detects the degree of opening of the throttle valve, and a detecting means which detects that at least either the switch means or the throttle valve opening degree detecting means is normal and the engine is in the idling mode, wherein the control means performs a feed-back control operation to control the idling speed of the engine upon the reception of the detection signal provided by the detecting means.

* * * * *